US007765835B2

(12) United States Patent
Karayianni et al.

(10) Patent No.: US 7,765,835 B2
(45) Date of Patent: Aug. 3, 2010

(54) ELASTIC COMPOSITE YARN, METHODS FOR MAKING THE SAME, AND ARTICLES INCORPORATING THE SAME

(75) Inventors: Eleni Karayianni, Geneva (CH); Philippe Chaudron, Sant Julien en Genevois (FR); George W. Coulston, Pittsburgh, PA (US)

(73) Assignee: Textronics, Inc., Wilmington, DE (US)

( * ) Notice: Subject to any disclaimer, the term of this patent is extended or adjusted under 35 U.S.C. 154(b) by 180 days.

(21) Appl. No.: 11/719,116

(22) PCT Filed: Nov. 8, 2005

(86) PCT No.: PCT/IB2005/003345

§ 371 (c)(1),
(2), (4) Date: Jul. 16, 2008

(87) PCT Pub. No.: WO2006/051384

PCT Pub. Date: May 18, 2006

(65) Prior Publication Data

US 2009/0071196 A1 Mar. 19, 2009

Related U.S. Application Data

(60) Provisional application No. 60/627,168, filed on Nov. 15, 2004.

(51) Int. Cl.
*D04B 1/18* (2006.01)

(52) U.S. Cl. ..... 66/172 E

(58) Field of Classification Search ..... 66/170, 66/172 E, 202; 57/210, 225, 231
See application file for complete search history.

(56) References Cited

U.S. PATENT DOCUMENTS

| | | | |
|---|---|---|---|
| 3,273,978 | A | 9/1966 | Victor |
| 3,288,175 | A | 11/1966 | Valko |
| 3,336,174 | A | 8/1967 | Dyer et al. |
| 3,354,630 | A | 11/1967 | Segal |
| 3,625,809 | A | 12/1971 | Caroselli et al. |
| 3,979,648 | A | 9/1976 | Toyoshima et al. |
| 4,160,711 | A | 7/1979 | Nishizawa et al. |
| 4,226,076 | A | 10/1980 | Griset, Jr. |
| 4,228,641 | A | 10/1980 | O'Neil |
| 4,234,907 | A | 11/1980 | Daniel |
| 4,239,046 | A | 12/1980 | Ong |
| 4,299,884 | A | 11/1981 | Payen et al. |
| 4,433,536 | A | 2/1984 | O'Neil |
| 4,525,992 | A | 7/1985 | Payen et al. |

(Continued)

FOREIGN PATENT DOCUMENTS

| | | | |
|---|---|---|---|
| DE | 10342787 | A1 | 5/2004 |

(Continued)

*Primary Examiner*—Danny Worrell
(74) *Attorney, Agent, or Firm*—Connolly Bove Lodge & Hutz LLP

(57) ABSTRACT

An elastic composite yarn comprises a composite core and a composite covering. The composite core comprises an elastic core member and an inelastic functional core member. The composite covering comprises at least an elastic covering member and at least one inelastic covering member surrounding the elastic covering member, such that substantially all of an elongating stress imposed on the composite yarn is carried by the elastic core member and the elastic covering member.

18 Claims, 10 Drawing Sheets

U.S. PATENT DOCUMENTS

| | | | | |
|---|---|---|---|---|
| 4,544,603 | A | 10/1985 | Richards | |
| 4,572,960 | A | 2/1986 | Ebneth et al. | |
| 4,583,547 | A | 4/1986 | Granek et al. | |
| 4,651,163 | A | 3/1987 | Sutera et al. | |
| 4,654,748 | A | 3/1987 | Rees | |
| 4,777,789 | A | 10/1988 | Kolmes et al. | |
| 4,813,219 | A | 3/1989 | Rees | |
| 4,878,148 | A | 10/1989 | Hee et al. | |
| 4,885,663 | A | 12/1989 | Parker | |
| 4,907,132 | A | 3/1990 | Parker | |
| 4,929,803 | A | 5/1990 | Yoshida et al. | |
| 5,042,900 | A | 8/1991 | Parker | |
| 5,102,727 | A | 4/1992 | Pittman et al. | |
| 5,103,504 | A | 4/1992 | Dordevic | |
| 5,275,861 | A | 1/1994 | Vaughn | |
| 5,288,544 | A | 2/1994 | Mallen et al. | |
| 5,503,887 | A | 4/1996 | Diaz et al. | |
| 5,568,964 | A | 10/1996 | Parker et al. | |
| 5,632,137 | A | 5/1997 | Kolmes et al. | |
| 5,771,027 | A | 6/1998 | Marks et al. | |
| 5,906,004 | A | 5/1999 | Lebby et al. | |
| 5,910,361 | A | 6/1999 | Guevel et al. | |
| 5,927,060 | A | 7/1999 | Watson | |
| 5,968,854 | A | 10/1999 | Akopian et al. | |
| 6,105,224 | A | 8/2000 | O'Mara, Jr. et al. | |
| 6,138,336 | A | 10/2000 | Goineau | |
| 6,145,551 | A | 11/2000 | Jayaraman et al. | |
| 6,341,504 | B1 | 1/2002 | Istook | |
| 6,356,238 | B1 | 3/2002 | Gainor et al. | |
| 6,377,216 | B1 | 4/2002 | Cheadle et al. | |
| 6,381,482 | B1 | 4/2002 | Jayaraman et al. | |
| 6,399,879 | B1 | 6/2002 | Ueda et al. | |
| 6,519,979 | B2 * | 2/2003 | Freedman | 66/142 |
| 6,581,366 | B1 | 6/2003 | Andrews | |
| 6,677,917 | B2 | 1/2004 | Van Heerden et al. | |
| 6,680,707 | B2 | 1/2004 | Allen et al. | |
| 6,701,703 | B2 * | 3/2004 | Patrick | 57/229 |
| 6,738,265 | B1 | 5/2004 | Svarfvar et al. | |
| 6,803,332 | B2 | 10/2004 | Andrews | |
| 6,856,715 | B1 | 2/2005 | Ebbesen et al. | |
| 6,970,731 | B1 | 11/2005 | Jayaraman et al. | |
| 7,059,714 | B2 * | 6/2006 | Kaeding et al. | 428/32.1 |
| 7,135,227 | B2 | 11/2006 | Karayianni et al. | |
| 7,147,904 | B1 | 12/2006 | Crawford | |
| 7,240,522 | B2 * | 7/2007 | Kondou et al. | 66/195 |
| 7,413,802 | B2 * | 8/2008 | Karayianni et al. | 57/211 |
| 7,504,127 | B2 | 3/2009 | Karayianni et al. | |
| 2002/0050446 | A1 | 5/2002 | Antoniazzi | |
| 2002/0130624 | A1 | 9/2002 | Nakamura | |
| 2002/0189839 | A1 | 12/2002 | Wagner et al. | |
| 2003/0224681 | A1 | 12/2003 | Koch | |
| 2004/0023576 | A1 | 2/2004 | Rock et al. | |
| 2004/0171284 | A1 | 9/2004 | Sweetland et al. | |
| 2004/0209059 | A1 | 10/2004 | Foss | |
| 2004/0216287 | A1 | 11/2004 | Bakker et al. | |
| 2004/0235381 | A1 | 11/2004 | Iwasaki et al. | |
| 2004/0237494 | A1 | 12/2004 | Karayianni et al. | |
| 2005/0282009 | A1 | 12/2005 | Nusko et al. | |

FOREIGN PATENT DOCUMENTS

| | | | |
|---|---|---|---|
| EP | 0111070 | A1 | 6/1984 |
| EP | 1 319 741 | A1 | 6/2003 |
| FR | 2031797 | | 11/1970 |
| FR | 2 745 690 | A1 | 9/1997 |
| GB | 2156592 | | 10/1985 |
| GB | 2361431 | | 10/2001 |
| WO | WO-92/13352 | A1 | 8/1992 |
| WO | 9516877 | A1 | 6/1995 |
| WO | WO-01/02052 | A2 | 1/2001 |
| WO | WO-01/37366 | A1 | 5/2001 |
| WO | WO-01/39326 | A1 | 5/2001 |
| WO | 0212785 | A1 | 2/2002 |
| WO | 02068862 | A1 | 9/2002 |
| WO | WO-02/071935 | A1 | 9/2002 |
| WO | WO-03/094717 | A1 | 11/2003 |
| WO | WO-2004/006700 | A1 | 1/2004 |
| WO | WO-2004/027132 | | 4/2004 |
| WO | 2004057079 | A1 | 7/2004 |
| WO | WO-2004/058346 | A1 | 7/2004 |
| WO | 2004097089 | A1 | 11/2004 |
| WO | WO-2004100784 | A2 | 11/2004 |

* cited by examiner

ELASTIC COMPOSITE YARN, METHODS FOR MAKING THE SAME, AND ARTICLES INCORPORATING THE SAME

FIELD OF THE INVENTION

The present invention relates to elastified yarns containing high modulus or low bending functional fibers, a process for producing the same, and to stretch fabrics, garments, and other articles incorporating such yarns. The invention also relates to novel elastified yarns made via yarn covering processes in which at least one covering member is, itself, an elastified yarn.

BACKGROUND OF THE INVENTION

Fabrics with functional properties have been disclosed for use in textile yarns. Examples include metallic yarns that can be used for carrying electrical current, performing an anti-static electricity function, or providing shielding from electric fields. Such yarns or fibers can, for example, include: multifilament stainless steel yarns; metallized aramid fibers; optical fibers for transmitting electrical data by acting as light waveguides; and glass or silica fibers for dielectric high frequency applications, Such highly functional yarns have been fabricated into fabrics, garments and apparel articles.

It is generally considered to be impractical to base a textile yarn solely on such high modulus filaments or on a combination yarn where the high modulus filaments are required to be a flex member of the yarn. Such high modulus filaments can typically be expected to exhibit low bending capability and poor flexibility.

Sources of stainless steel continuous multifilament fibers typically used in textiles include, but are not limited to: NV Bekaert SA, Kortrijk, Belgium; and Sprint Metal Groupe Arcelor, France. Depending on the number of filaments and the number of twisted yarns involved, these yarns usually have a filament diameter from about 6 μm to about 12 μm, and an electrical resistivity in the range of about 2 Ohm/m to about 70 Ohm/m. In general, these metal fibers exhibit a high force to break, typically in the range of about 20 N to about 500 N and relativity little elongation, typically less than about 5%. However, these fibers exhibit substantially no elasticity. In contrast, many elastic synthetic polymer based textile yarns stretch to at least about 125% of their unstressed specimen length and recover more than about 50% of this elongation upon relaxation of the stress.

Sources of plastic optical fibers for use in textiles include, but are not limited to: Toray Industries, Inc.; Mitsubishi Corporation; and Asahi Chemical. Typically, these fibers have diameters of about 0.5 to about 2 mm. Due to their construction, such fibers have the ability to transmit light along their length via total internal reflection, which light can then be converted into electrical energy or signals. This property of optical fibers tends to make them advantageous as compared to metal wires or coaxial transmission for data signal transmission, especially due to their relatively higher bandwidth, lower attenuation, lower noise, and lower cost.

Sources of metallized fibers include metallic coatings added on the surface of aramid fibers, such as Aracon® manufactured and sold by E.I. DuPont de Nemours. These yarns are based on stranded Kevlar® fibers, having an equivalent diameter to metal wire of about 54 AWG and electrical resistivity in the range of about 2 Ohms/m to about 9 Ohms/m. In general, these metallic fibers have a load to break of about 27 N to about 70 N and an elongation to break of less than about 5%.

Sources of inorganic quartz or silica fibers for use in textiles include, but are not limited to those made by Saint-Gobain (France). These fibers generally have filament diameters of about 1 μm to about 25 μm, a dielectric constant in the range of about 3 to about 7 in the frequency range up to about 10 GHz, and a loss tangent of about 0.0001 to about 0.0068 in the frequency range up to about 10 GHz. In general, these fibers exhibit a high tensile strength in the range of about 2000 $N/mm^2$ to about 6000 $N/mm^2$, high tensile modulus of about 50,000 $N/mm^2$ to about 90,000 $N/mm^2$, and relativity little elongation of about 2 to about 8%.

State of the Art: Plastic Optical Fibers in Textiles

Woven fabrics made by incorporation of optical fibers are known in the art. Typically, such optical fibers have an internal core and an external sheath. The external sheath has a lower refractive index compared to the internal core, which causes total internal reflection of light so that light travels solely through the internal core of the fiber. Light may be caused to escape from the surface of the fiber, thus creating an illuminating effect. There are two major directions disclosed for such effect: (1) attack of the fiber surface (mechanical or chemical), (2) deformation or bending of the fiber, at discrete locations along the fiber length.

(1) State-of-the-art Illumination by Optical Fibers Via Mechanical Attack

U.S. Pat. No. 4,234,907 to Maurice, discloses a light-emitting fabric woven with optical fibers for use in clothing, interior, or technical textiles. Optical fibers are woven in the warp direction crossed with normal textile fibers as weft threads. The optical fibers are illuminated at one end by a light source. Illumination from the surface of the fiber is achieved by making notches at the cladding till the inner core, the spacing of which becomes narrower as the distance from the light source increases so that there is a uniform distribution of light across the fabric. Analysis or such fabric makes it unsuitable for industrial manufacturing, as the notches weaken the fiber, making textile processing impossible, while the bundling of all fiber ends into a light source would require extreme fiber length extending out of the fabric.

WO 02/12785 A1 to Givoletti, discloses a textile incorporating illuminated fibers. The fibers consist of a central core capable of transmitting light and of an external sheath that presents a refractive index, which in respect to the internal core, allows the transmitted light to escape partially from the fiber. Illumination is achieved by texturing the fibers (via e.g. abrasions, scratching), adding doping elements inside the fiber that modify the diffusion angle of light, modifying the refractive index of the cladding so as to disperse the light along the fiber, and modifying the reflective index of the optical fibers by fabric treatment through mechanical or chemical means. Further the reference discloses a special woven construction that illuminates light uniformly.

WO 02/068862A1 to Deflin et al., discloses a lighting device based on optical fibers with light-emitting segments, a possible structure of such a device including optical fibers that are woven into a textile together with other textile fibers. In 2002, France Telecom won the Avantex Innovation Prize for the presentation of a first flexible display based on an optical fiber fabric (E. Deflin, et. al., "Communicating Clothes: Optical Fiber Fabric for a New Flexible Display", $2^{nd}$ International Avantex Symposium, Frankfurt, Germany). Optical fibers were processed via a special process of fiber surface mechanical attack, disclosed in PCT/FR94/01475, to A. Bernasson, et al., allowing for light to be scattered throughout the outer surface of the fibers at controlled locations on the length of the fiber. The fibers were then woven into a fabric. They were lighted through LEDs that could be used to light groups of fibers, each group representing one pixel of the matrix. By controlling the matrix through wireless telecommunication services, various patterns can be generated in the cloth, hence providing for an intelligent display. Although fine fiber diameters were used (about 0.5 mm), it was not optimal to create an X-Y network by introducing the fibers both in the weft and warp directions, as the fabric would be very rigid and the grid not very dense. Therefore, such fabrics would not be appropriate for typical clothing applications, where flexibility and freedom of movement of the fabric are of paramount importance. Further, special processing of the fibers is needed to transmit light from the surface of the optical fiber.

WO 2004/057079A1 to Laustsen, discloses a woven fabric with optical fibers that goes beyond the disclosure of U.S. Pat. No. 4,234,907 by allowing optical fibers to extend in mutually crossing directions in the fabric. According to the Laustsen reference, the fabric is hot rolled to compress and flatten the light guides, and further is laser treated to create partial ruptures at the surface of the optical fibers.

(2) State-of-the-art Illumination by Optical Fibers Via Bending

U.S. Pat. Nos. 4,885,663, 4,907,132, 5,042,900, and 5,568, 964 to Parker et al., disclose fiber optic light emitting panel assemblies made of woven optical fibers. Light is caused to be transmitted from the optical fiber surfaces by deforming or bending the optical fibers at discrete locations along their length such that the angle of bend exceeds the angle of internal reflection. The optical fibers are typically woven in the warp direction, while till threads are woven in the weft direction, although the fill threads are also allowed to be optical fibers. The output pattern of light is achieved by controlling the weave spacing and pattern of the optical fibers and fill threads. A portion of the light emitting area is sealed by adhering the optical fibers and fill threads together to hold the fill threads in position and keep the optical fibers from separating from the light emitting portion.

UK 2,361,431A to Whitehurst, discloses a fiber optic fabric for phototherapy, wherein light emitted from the surface of the optical fibers (including plastic and glass optical fibers) is directed towards a patient for the treatment of large area skin conditions for therapy, or cosmetic treatment. The inventor found that by weaving the optical fiber together with other fill yarns, the optical fiber bending around the fill fibers causes light to be refracted out of the optical fiber and hence out of the fabric. It is disclosed that when a large number of optical fibers is woven in this way, the fabric will emit light in a generally uniform distribution across the fabric. For the use of the fabric for phototherapy, it is very important that the fabric has flexibility to provide the necessary movement and comfort for the user, and that it follows the skin area that needs to be protected. However, it is known that fabrics based on optical fibers are rigid and tough for wearable clothing and wilt generally not allow movement of the fabric in the direction of optical fibers. Therefore, such a fabric may not provide for the desired flexibility or be optimum for the intended application.

(3) State-of-the-art Optical Fibers for Signal Transmission

U.S. Pat. No. 6,381,482B1 to Jayaraman et al., discloses a tubular knitted or woven fabric, or a woven or knitted 2-dimensional fabric, including integrated flexible information infrastructure for collecting, processing, transmitting, and receiving information concerning a wearer of the fabric. The fabric consists of a base fabric providing for wear comfort and an information component, which includes sheathed plastic optical fiber to provide a penetration detection means as well as data transferring information. The fabric, consisting of the optical fibers, is then integrated into a garment structure by joining techniques such as sewing, gluing or attachment.

Optical fibers as sensors have also been used in textile composites to distribute sensing locally (point) or multiplexed (multi-point) exploiting intensiometric, interferometric, or Bragg grating principles. See X. M. Tao, J. Text. Inst. 2000, Vol 91 Part 1, No. 3, pp 448-459; and W. C. Du et al., J. Compos. Struct. Vol 42, pp. 217-230, (1998). Optical fibers can provide an effective means to determine quantitatively the distribution of physical parameters (e.g., temperature, stress-strain, pressure), and therefore may find uses in smart structures applications, such as monitors of manufacturing processes and internal-health conditions. In these developments, the embedded optical fibers also act as signal-transmission elements.

Stretch and recovery is considered to be an especially desirable property of a yarn, fabric or garment, which is also able to conduct electrical current, transmit data processing information, illuminate, sense, and/or provide electric field shielding. The stretch and recovery property, or "elasticity", is the ability of a yarn or fabric to elongate in the direction of a biasing force (in the direction of an applied elongating stress) and return substantially to its original length and shape, substantially without permanent deformation when the applied elongating stress is relaxed. In the textile arts, it is common to express the applied stress on a textile specimen (e.g., a yarn or filament) in terms of a force per unit of cross section area of the specimen or force per unit linear density of the unstretched specimen. The resulting strain (elongation) of the specimen is expressed in terms of a fraction or percentage of the original specimen length. A graphical representation of stress versus strain is the stress-strain curve, which is well-known in the textile arts.

The degree to which a fiber, yarn, or fabric returns to the original specimen length prior to being deformed by an applied stress is called "elastic recovery". In stretch and recovery testing of textile materials, it is also important to note the elastic limit of the test specimen. The elastic limit is the stress load above which the specimen shows permanent deformation. The available elongation range of an elastic filament is that range of extension throughout which there is no permanent deformation. The elastic limit of a yarn is reached when the original test specimen length is exceeded after the deformation inducing stress is removed. Typically, individual filaments and multifilament yarns elongate (strain) in the direction of the applied stress. This elongation is measured at a specified load or stress. In addition, it is useful to note the elongation at break of the filament or yarn specimen. This breaking elongation is that fraction of the original specimen length to which the specimen is strained by an applied stress which ruptures the last component of the specimen filament or multifilament yarn. Generally, the drafted length is given in terms of a draft ratio equal to the number of times a yarn is stretched from its relaxed unit length.

Elastic fabrics having conductive wiring affixed to the fabric for use in garments intended for monitoring of physiological functions in the body are disclosed in U.S. Pat. No. 6,341, 504 to Istook. This patent discloses an elongated band of elastic material stretchable in the longitudinal direction and having at least one conductive wire incorporated into or onto the elastic fabric band. The conductive wiring in the elastic fabric band is formed in a prescribed curved configuration, e.g., a sinusoidal configuration. This elastic conductive band is able to stretch and alter the curvature of the conduction wire. As a result, the electrical inductance of the wire is changed. This property change is used to determine changes in physiological functions of the wearer of a garment including such a conductive elastic band. The elastic band is formed in part using an elastic material, preferably spandex. Filaments of the spandex material, sold by INVISTA® North America Sà r. I., Wilmington, Del., under the trademark LYCRA®, are disclosed as being a desirable elastic material. Conventional textile means to form the conductive elastic band are disclosed, including: warp knitting, weft knitting, weaving, braiding, and non-woven construction. Other textile filaments, in addition to metallic filaments and spandex filaments, are included in the conductive elastic band. These other filaments include nylon and polyester.

While elastic conductive fabrics with stretch and recovery properties dominated by a spandex component of the composite fabric band have been disclosed, these conductive fabric bands are intended to be discrete elements of a fabric construction or garment used for prescribed physiological function monitoring. Although such elastic conductive bands may have advanced the art in physiological function monitoring, they have not been shown to be satisfactory for use in a way other than as discrete elements of a garment or fabric construction.

In view of the foregoing, it is believed desirable to provide high modulus functional textile yarns, including but not limited to conductive, fiber optic, and glass fibers, wherein such textile yarns have elastic recovery properties that can be processed using traditional textile means to produce knitted, woven, or nonwoven fabrics ("elastic functional yarns"). Further, it is believed that there is yet a need for fabrics and garments that are substantially constructed from such elastic functional yarns. Fabrics and garments substantially constructed from elastic functional yarns can provide stretch and recovery characteristics to the entire construction, conforming to any shape, any shaped body, or requirement for elasticity. It is further believed desirable to provide controlled loops (bends) of such high modulus functional fibers, either individually or within the fabric construction, so as to provide for special illumination effects, as in the case of optical fibers, or special electrical signals, as in the case of conductive fiber loops for inductive signal generation and transmission.

SUMMARY OF THE INVENTION

The present invention is directed to an elastic composite yarn comprising (a) a composite core member and (b) a composite covering member, wherein the composite core member comprises: (i) an elastic core member having relaxed unit length L and a drafted length of (N×L), wherein N is in the range of about 1.0 to about 8.0; and (ii) an inelastic functional core member having a fixed length of (N×L). The composite covering member comprises (i) at least one elastic covering member. Preferably, the composite covering member further comprises (ii) at least one inelastic covering member surrounding the elastic covering member. The composite covering member has a relaxed length that is greater than the drafted length (N×L) of the elastic core member, such that substantially all of an elongating stress imposed on the composite yarn is carried by the elastic core member and the elastic covering member.

The present invention is also directed to methods for forming an elastic composite yarn. One method includes the step of first providing (a) a composite core and (b) a composite covering, wherein the composite core comprises: (i) a first elastic member having relaxed unit length L and a drafted length of (N×L), wherein N is in the range of about 1.0 to about 8.0; and (ii) an inelastic functional member having a fixed length of N×L; and the, composite covering comprises (i) a second elastic member and (ii) at least one inelastic member. Further steps of the method include: drafting the first elastic member to a drafted length of (N×L), placing the inelastic functional member substantially parallel to and in contact with the drafted length of the first elastic member, and, thereafter, covering, twisting or wrapping in turns the composite covering about the drafted first elastic member and the inelastic functional member. The composite covering may be wrapped in the relaxed state or under tension. In addition, the at least one inelastic member of the composite covering may be wrapped in turns about the second elastic member, or the at least one inelastic member of the composite covering and the second elastic member may be twisted together.

It also lies within the scope of the present invention to provide a knit, woven or nonwoven fabric substantially constructed from functional elastic composite yarns of the present invention. Such fabrics may be used to form a wearable garment or other fabric articles substantially.

It further lies within the scope of the present invention to provide a novel means of forming loops (or bends) of the functional fiber member at discrete locations along the length of the fiber when such fiber is integrated into a knit, woven or nonwoven fabric. Such embodiments can further include a means of dynamically controlling such loops (for example, their size, bending angle, position) via the stretch and recovery function of such fabric.

BRIEF DESCRIPTION OF THE DRAWINGS

The invention will be more fully understood from the following detailed description, taken in connection with the accompanying drawings, which form a part of this application and in which.

DETAILED DESCRIPTION OF THE INVENTION

Figure 1A:
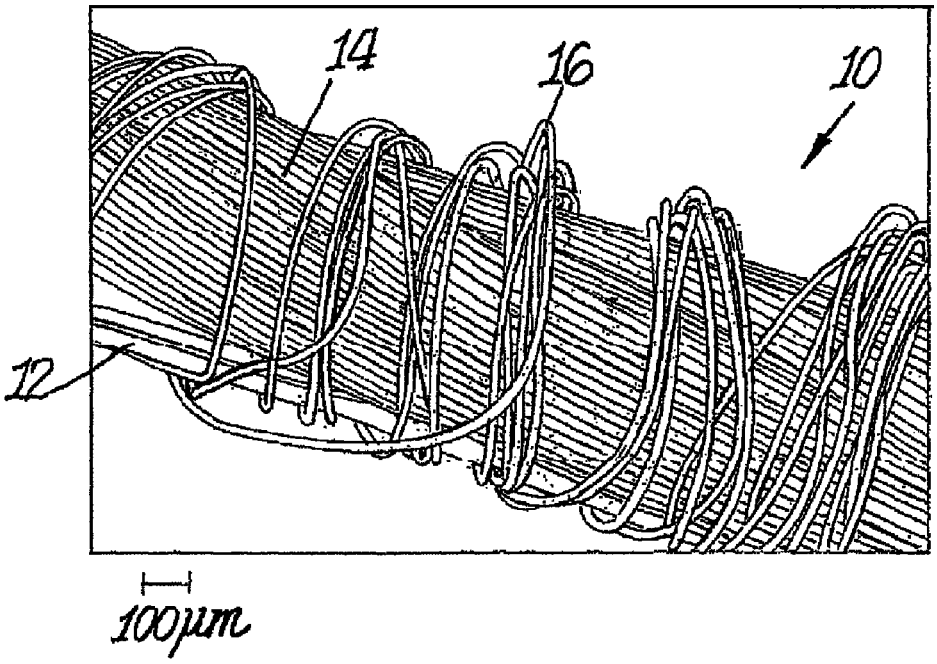
FIGS. 1A and 1B show scanning electron micrographs (SEMs) of 100% stainless steel in parallel to Lycra® yarn type T-162C, single covered with a 22/7 dtex/7 filament flat nylon yarn twisted to the "S" direction at 500 turns per meter (tpm) in the relaxed state and in the relaxed state after break respectively.

In accordance with the present invention it has been found that it is possible to produce an elastic composite yarn containing high modulus or low bending fibers or yarns. Elastic composite yarns falling within the scope of the present invention comprise a composite core comprising: (a) an elastic core member (or "elastic core"); and (b) an inelastic functional core member, wherein the composite core is surrounded by at least one composite covering.

The elastic core member has a predetermined relaxed unit length (L) and a predetermined drafted length of (N×L), where N is a number, preferably in the range from about 1.0 to about 8.0, representing the draft applied to the elastic member. The inelastic functional core member has a fixed length of (N×L).

Elastic composite yarns falling within the scope of the present invention further include at least one composite covering. The composite covering includes: (i) at least one elastic covering member; and (ii) at least one inelastic covering member surrounding the elastic covering member. The composite covering has a relaxed length that is equal to or greater than the drafted length of the elastic core member, such that substantially all of an elongating stress imposed on the composite yarn is carried by the elastic core member and the elastic covering member.

The Elastic Core Member

The elastic core member may be implemented using one or a plurality (i.e., two or more) of filaments of an elastic yarn, such as that spandex material sold by INVISTA North America S.àr.I. (Wilmington, Del., USA, 19880) under the trademark LYCRA®.

The drafted length (N×L) of the elastic core member is defined to be that length to which the elastic member may be stretched and return to within about five percent (5%) of its relaxed (stress free) unit length L. More generally, the draft (N) applied to the elastic core member is dependent upon the chemical and physical properties of the polymer comprising the elastic cure member and the covering and textile process used. In the covering process for elastic members made from spandex yarns a draft of typically is between about 1.0 and about 8.0, and most preferably about 1.2 to about 5.0

Alternatively, synthetic bicomponent multifilament textile yarns may also be used to form the elastic core member. The synthetic bicomponent filament component polymers are thermoplastic, more preferably the synthetic bicomponent filaments are melt spun, and most preferably the component polymers are selected from the group consisting of polyamides and polyesters.

A preferred class of polyamide bicomponent multifilament textile yarns are those nylon bicomponent yarns which are self-crimping, also called "self-texturing" These bicomponent yarns comprise a component of nylon 66 polymer or copolyamide having a first relative viscosity and a component of nylon 66 polymer or copolyamide having a second relative viscosity, wherein both components of polymer or copolyamide are in a side-by-side relationship as viewed in the cross section of the individual filament. Self-crimping nylon yarn such as the yarn sold by INVISTA North America S.à.r.I. under the trademark TACTEL® T-800™ is an especially useful bicomponent elastic yarn.

The preferred polyester component polymers include polyethylene terephthalate (PET), polytrimethylene terephthalate (PTT) and polytetrabutylene terephthalate. The more preferred polyester bicomponent filaments comprise a component of PET polymer and a component of PTT polymer. Both components of the filament can be in a side-by-side relationship as viewed in the cross section of the individual filament. An especially advantageous filament yarn meeting this description is that yarn sold by INVISTA North America S.àr.I. under the trademark T-400™ Next Generation Fiber. The covering process for elastic members from these bicomponent yarns involves the use of less draft than with spandex.

Typically, the draft for both polyamide or polyester bicomponent multifilament textile yarns is between about 1.0 and about 5.0.

The Functional Core Member

The term "functional core member" refers to one or more fibers that has at least one functionality or exhibits at least one property that extends beyond mechanical properties commonly associated with textile fibers. Functionalities or properties associated with such members can, for example, include fiber optic data transmission, dielectric high frequency applications (i.e., those using glass and/or silica fibers), activity under electrical, optical or magnetic fields, ability to convert energy from one form of energy to another, and sensory, monitoring or actuation applications.

The functional core member may, for example, be selected from the family of low bending modulus fibers, including stainless steel fiber, stainless steel yarn, conductive metallized aramid fibers, Plastic Optical Fiber (POF), and silica or glass optical fibers. The inelastic functional core member may, for example, have a force to break of greater than 2N in an elongation limit of less than 20% or a yield point of greater than 2N in an elongation limit of less than 20%.

The functional core member can further include: piezoelectric fibers from polymers (e.g., polyamide 7, polyamide 11), or from ceramic fiber composites; electrostrictive polymers; electrostrictive elastomers, ferroelectric fibers; magnetostrictive polymers or fiber composites; photonics fibers and nanocomposite fibers; thermoresponsive (e.g., shape memory wires of polymers or metal alloys); photoluminescent and electrochromic fibers; and light sensitive liquid crystal containing fibers In its most basic form, the functional core member comprises one or a plurality (i.e., two or more) strand(s) of functional fibers.

In an alternative form, the functional core member comprises a synthetic polymer yarn having one or more functional fibers(s) thereon. Suitable synthetic polymer yarns are selected from among continuous filament nylon yarns (e.g., from synthetic nylon polymers commonly designated as N66, N6, N610, N612, N7, N9), continuous filament polyester yarns (e.g., from synthetic polyester polymers commonly designated as PET, 3GT, 4GT, 2GN, 3GN, 4GN), staple nylon yarns, or staple polyester yarns. Such composite functional yarns may be formed by conventional yarn spinning techniques to produce composite yarns, such as plied, spun or textured yarns.

Composite Covering

The composite covering of the present invention comprises an elastic covering member and an inelastic covering member around or surrounding the elastic covering member. The length of the composite covering should be greater than, or equal to, the drafted length (N×L) of the elastic core member.

The elastic covering member may be comprised of any of the materials that can be used to for the elastic core member, The inelastic covering member may be selected form non-conducting inelastic synthetic polymer fiber(s) or from natural textile fibers like cotton, wool, silk and linen. These synthetic polymer fibers may be continuous filament or staple yarns selected from multifilament flat yarns, partially oriented yarns, textured yarns, bicomponent yarns selected from nylon, polyester or filament yarn blends.

Optionally, the inelastic covering member may be a functional yarn with a tensile strength or less than 4N or a yield point of less 4N. Such functional yarns can include yarns with electrical or optical properties, such as a metal wire.

The inelastic covering member is preferably nylon. Nylon yarns comprised of synthetic polyamide component polymers such as nylon 6, nylon 66, nylon 46, nylon 7, nylon 9, nylon 10, nylon 11, nylon 610, nylon 612, nylon 12 and mixtures and copolyamides thereof are preferred. In the case of copolyamides, especially preferred are those including nylon 66 with up to 40 mole percent of a polyadipamide wherein the aliphatic diamine component is selected from the group of diamines available from INVISTA North America S.à r.l., (Wilmington, Del., USA, 19880) under the respective trademarks DYTEK A® and DYTEK EP®.

Making the inelastic covering member from nylon renders the composite yarn dyeable using conventional dyes and processes for coloration of textile nylon yarns and traditional nylon covered spandex yarns.

If the inelastic covering member is polyester, the preferred polyester is either polyethylene terephthalate (2GT, a.k.a. PET), polytrimethylene terephthalate (3GT, a.k.a. PTT) or polytetrahutylene terephthalate (4GT). Making the inelastic covering member from polyester multifilament yarns also permits ease of dyeing and handling in traditional textile processes.

The relative amounts of the functional core member and the composite covering are selected according to ability of the elastic core member to extend and return substantially to its unstretched length (that is, undeformed by the extension) and according to the functional properties of the functional core member. As used herein "undeformed" means that the elastic core member returns to within about +/− five percent (5%) of its relaxed (stress free) unit length L.

It has been found that any of the traditional textile process for single covering, double covering, air jet covering, entangling, twisting or wrapping of elastic filaments and materials useful as functional filaments with materials useful in the composite covering is suitable for making the functional elastic composite yarn according to the invention.

In most cases, the order in which the composite core is surrounded by or covered by the composite covering is immaterial for obtaining an elastic composite yarn. A desirable characteristic of these functional elastic composite yarns of this construction is their stress-strain behavior. For example, under the stress of an elongating applied force, the composite covering, disposed about the composite core in multiple wraps (typically from one turn (a single wrap) to about 10,000 turns), is free to extend without strain due to the external stress.

If the composite yarn is stretched near to the break extension of the elastic core member, the composite covering is available to take a portion of the load and effectively preserve the elastic core member and the functional core member and prevent them from breaking. The term "portion of the load" is used herein to mean any amount from 1 to 90 percent of the load, and more preferably 10% to 80% of the load; and most preferably 25% to 50% of the load.

Figure 12:
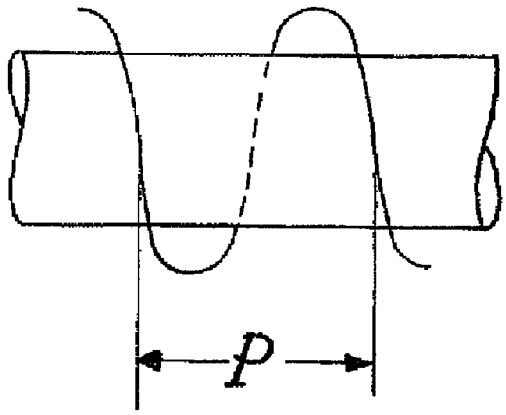
FIG. 12 is a schematic diagram of an elastic composite yarn according to the invention.

The composite core may optionally be sinuously wrapped by the composite covering. Sinuous wrapping is schematically represented in FIG. 12, where an elastic member 40, e.g., a LYCRA® yarn, is wrapped with an inelastic covering member 10, e.g., nylon, in such a way that the wraps are characterized by a sinuous period (P).

Specific embodiments and procedures of the present invention will now be described further, by way of example, as follows.

Test Methods

Measurement of Fiber and Yarn Stress-Strain Properties

Fiber and Yarn Stress-Strain Properties were determined using a dynamometer at a constant rate of extension to the point of rupture. The dynamometer used was that manufactured by Instron Corp, 100 Royall Street, Canton, Mass., 02021 USA.

The specimens were conditioned to about 22° C. ± about 1° C. and about 60% ± about 5% R.H. The test was performed at a gauge length of about 5 cm and crosshead speed of about 50 cm/min. Threads measuring about 20 cm were removed from the bobbin and let relax on a velvet board for at least 16 hours in air-conditioned laboratory. A specimen of this yarn was placed in the jaws with a pre-tension weight corresponding to the yarn dtex so as not to give either tension or slack.

Measurement of Fabric Stretch

Fabric stretch and recovery for a stretch woven fabric was determined using a universal electromechanical test and data acquisition system to perform a constant rate of extension tensile test. The system used was that from Instron Corp, 100 Royall Street, Canton, Mass., 02021 USA.

Two fabric properties were measured using this instrument: (1) fabric stretch and (2) fabric growth (deformation). The available fabric stretch was measured as the amount of elongation caused by a specific load between 0 and about 30 Newtons and expressed as a percentage change in length of the original fabric specimen as it was stretched at a rate of about 300 mm per minute. The fabric growth was measured as the unrecovered length of a fabric specimen which had been held at about 80% of available fabric stretch for about 30 minutes then allowed to relax for about 60 minutes. Where about 80% of available fabric stretch was greater than about 35% of the fabric elongation, this test was limited to about 35% elongation. The fabric growth was then expressed as a percentage of the original length.

The elongation or maximum stretch of stretch woven fabrics in the stretch direction was determined using a three-cycle test procedure. The maximum elongation measured was the ratio of the maximum extension of the test specimen to the initial sample length found in the third test cycle at load of about 30 Newtons. This third cycle value corresponds to hand elongation of the fabric specimen. This test was performed using the above-referenced universal electromechanical test and data acquisition system specifically equipped for this three-cycle test.

EXAMPLES

Reference numerals present in the discussion of the Examples refer to the reference characters used in the accompanying drawing(s).

Comparative Example 1

Figure 1B:
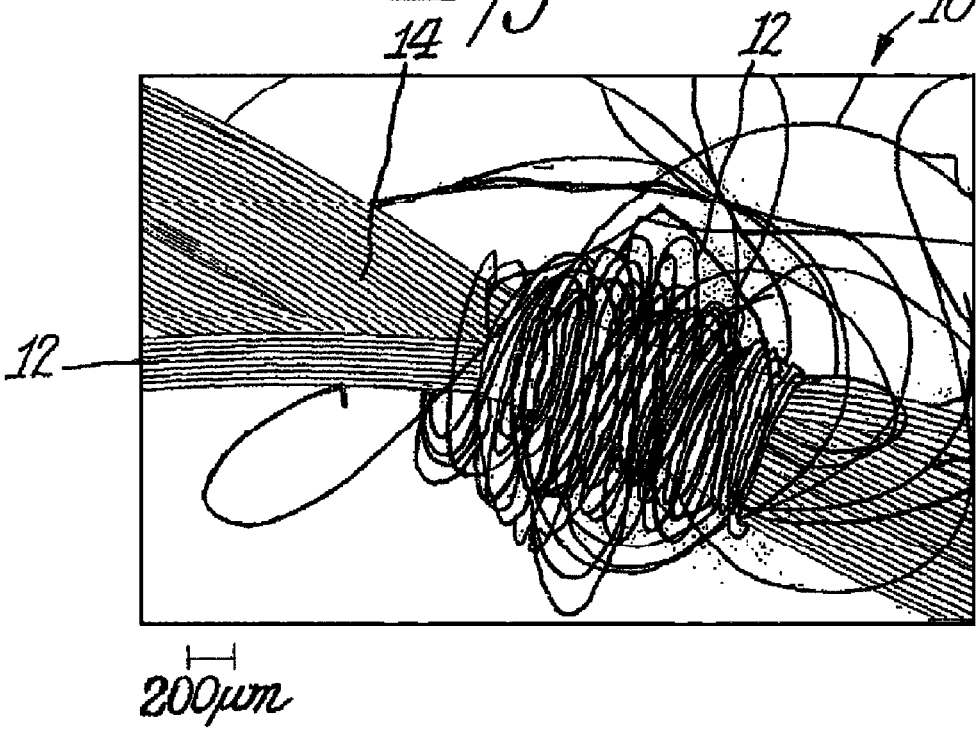

A 156 decitex (dtex) Lycra® yarn type T-162C was drafted by 3.8× its relaxed length, and fed in parallel to a 100% stainless steel yarn through a yarn covering I.C.B.T. machine model G307. The 100% stainless steel yarn was an endless multifilament yarn grade 316L consisting of two twisted threads with 275 filaments per thread and with a filament size of 12 obtained from Sprint Metal (France). This core composite yarn (consisting of Lycra® and stainless steel yarn) was single covered with a 22 dtex/7 filament flat nylon yarn twisted to the "S" direction at 500 tpm (turns per meter of drafted Lycra®). This yarn structure 10 is shown in FIG. 1A, with the Lycra® yarn 12 and stainless steel yarn 14 covered with the nylon yarn 16. As the yarn 10 is stretched, nylon cannot support the elastification and it breaks, as shown in FIG. 1B.

Comparative Example 2

Figure 2:
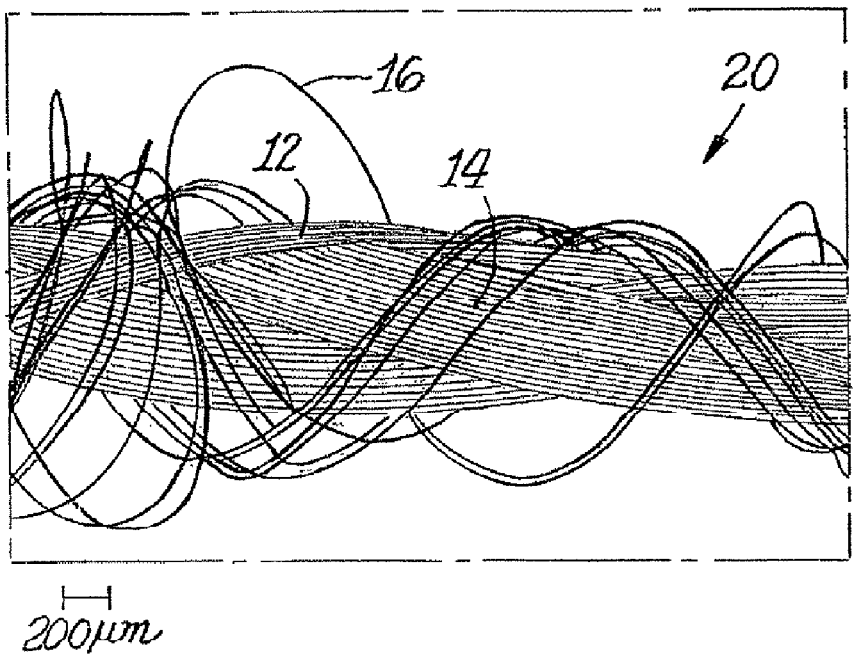
FIG. 2 shows scanning electron micrographs (SEMs) of 100% stainless steel in parallel to Lycra® yarn type T-162C, double covered with a 22/7 dtex/7 filament flat nylon yarn twisted to the "S" and "Z" directions at 300 tpm and 200 tpm.

A core composite yarn of Lycra® and stainless steel yarn as in Comparative Example 1 was double covered with a 22 dtex/7 filament flat nylon yarn twisted to the "S" direction at 300 tpm (turns per meter of drafted Lycra®) and to the "Z" direction at 200 tpm. This yarn structure 20 is shown in FIG. 2, with the Lycra® yarn 12 and stainless steel yarn 14 covered by the nylon 16. Despite the fact that the yarn 20 was covered to a higher degree compared to Comparative Example 1 of the invention, as the yarn 20 is stretched, nylon cannot support the elastification and it breaks.

Comparative Example 3

A covered yarn was produced as in Comparative Example 2, except it was twisted at 500 tpm in both the "S" and the "Z" directions. As the yarn is stretched, nylon cannot support the elastification and it breaks.

Comparative Example 4

Figure 3A:
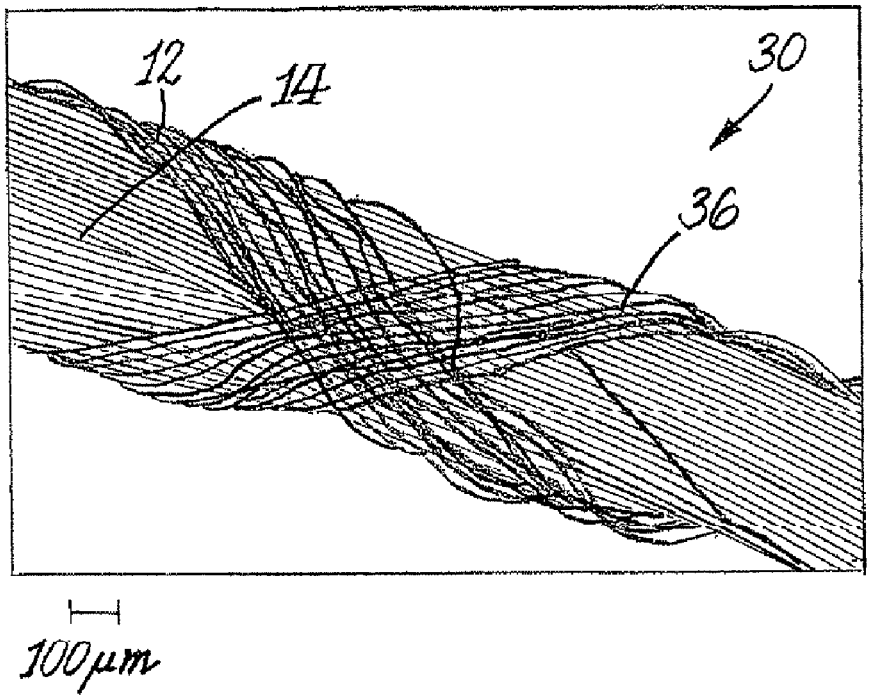
FIGS. 3A and 3B show scanning electron micrographs (SEMs) of 100% stainless steel in parallel to Lycra® yarn type T-162C, double covered with a nylon 44 dtex/20 filament textured yarn twisted to both the "S" and "Z" directions at 500 tpm in the relaxed state.
Figure 3B:
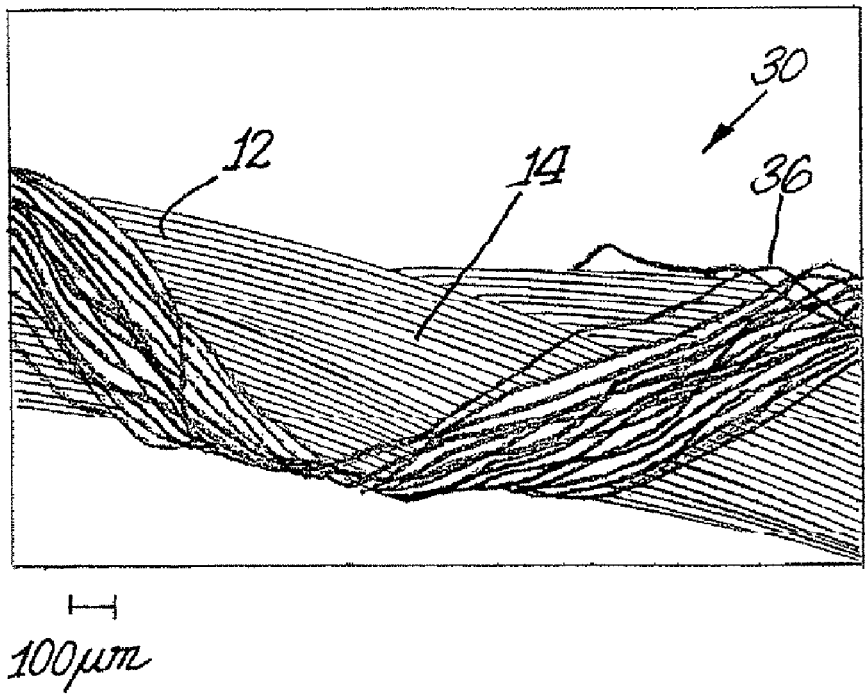

A covered yarn was produced as in Comparative Example 3, except that the nylon yarn used was a 44 dtex/20 filament textured yarn. The structure of this yarn 30 is shown in FIGS. 3A and 3B. Although a stronger nylon yarn 36 was used compared to Comparative Example 3, as the yarn 30 is stretched, nylon cannot support the elastification and it breaks.

Example 1

Figure 4:
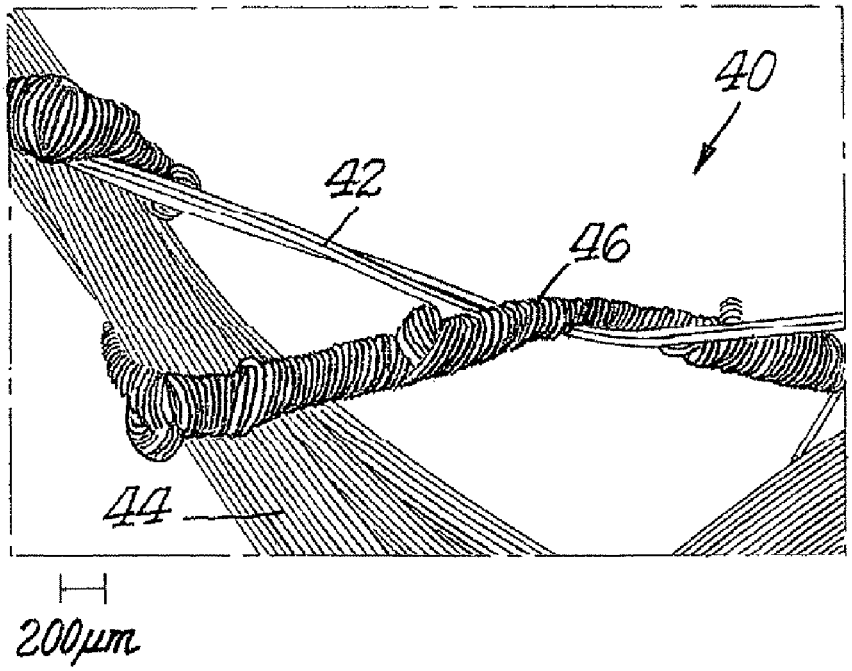
FIG. 4 shows a scanning electron micrograph (SEM) of 100% stainless steel in parallel to Lycra® yarn type T-162C, single covered with an elastified Lycra® yarn type T-902C (200 dtex, draft 5.2×) twisted to the "S" direction at 400 tpm.

A covered yarn was produced in a manner similar to that of Comparative Examples 1-4, except that the core composite yarn was single covered with an elastified yarn twisted to the "S" direction at 400 tpm. The elastified yarn was a double covered Lycra& yarn (type T-902C, 200 dtex, draft 5.2×). The structure of this yarn 40 is shown in FIG. 4, with Lycra® yarn 42 and stainless steel yarn 44 covered by elastified yarn 46. As shown in FIG. 4, this yarn 40 presents a structure at the relaxed state comprising of straight segments, where the covered yarn holds the core composite yarn in the stretched state, and of loops of stainless steel. As the yarn 40 is stretched, the loops of stainless steel yarn tend to stretch parallel to the Lycra® core providing a totally stretched yarn that remains intact during stretching. This yarn can be further processed by standard textile processes.

Comparative Example 5

Figure 5A:
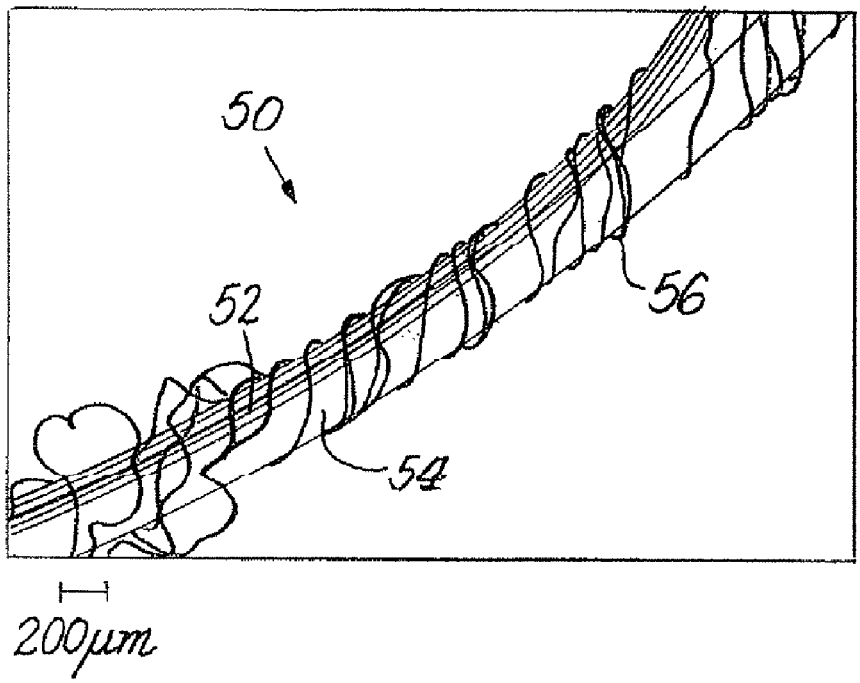
FIGS. 5A and 5B show scanning electron micrographs (SEMs) of a Raytela® plastic optical fiber in parallel to Lycra® yarn type T-162C, single covered with a 22 dtex/7 filament flat nylon yarn twisted to the "S" direction at 333 tpm in the stretched and relaxed state, respectively.
Figure 5B:
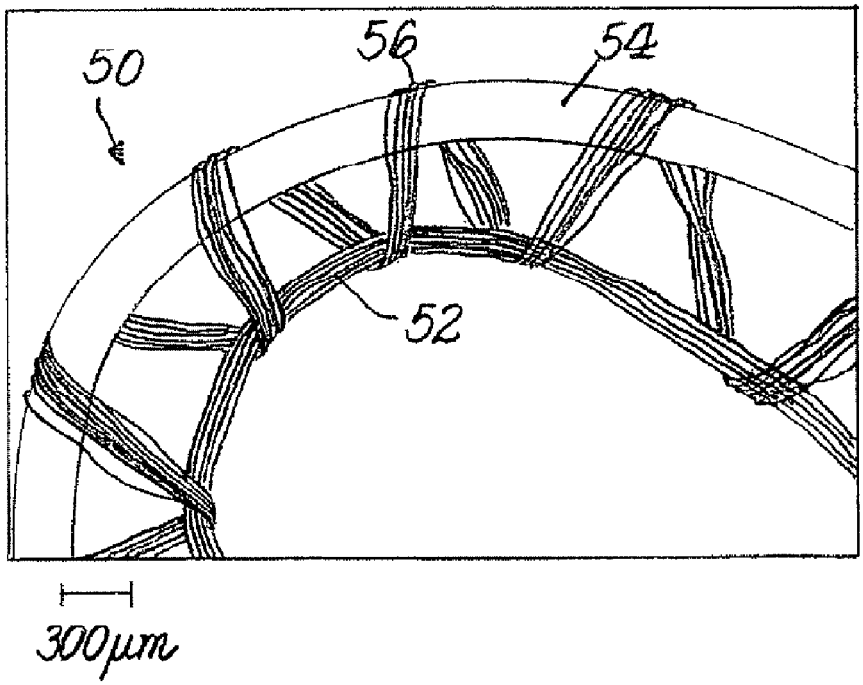

A 156 decitex (dtex) Lycra® yarn type T-162C was drafted by 3.8× its relaxed length, and fed in parallel to a plastic optical fiber through a yarn covering I.C.B.T. machine model G307. The plastic optical fiber was type Raytela® from Toray of 610 dtex that comprised a fluorinated polymer clad and polymethyl methacrylate core. This core composite yarn was single covered with a 22 dtex/7 filament flat nylon yarn twisted to the "S" direction at 333 tpm (turns per meter of drafted Lycra®). This yarn structure 50 is shown in FIG. 5B, with Lycra® yarn 52 and plastic optical fiber 54 covered by nylon yarn 56. This structure 50 creates large loops of the optical fiber 54 up to a few cm in diameter during relaxing, as shown in FIG. 5B. As the yarn 50 is stretched, nylon cannot support the elastification and it breaks, as shown in FIG. 5A.

Comparative Example 6

Figure 6A:
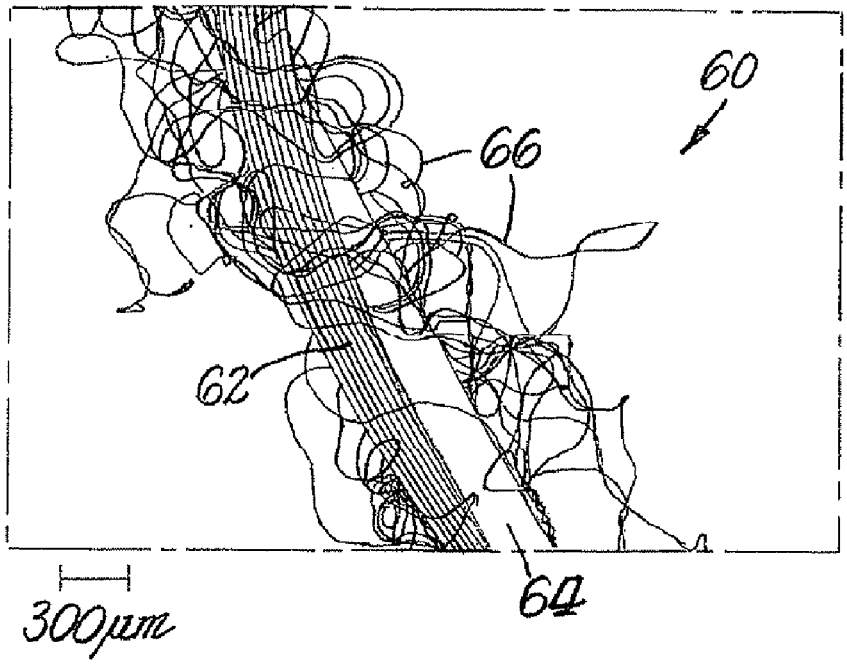
FIGS. 6A and 6B show scanning electron micrographs (SEMs) of Raytela® plastic optical fiber in parallel to Lycra® yarn type T-162C, single covered with a 44 dtex/20 filament nylon yarn twisted to the "S" direction at 100 tpm in the relaxed state.
Figure 6B:
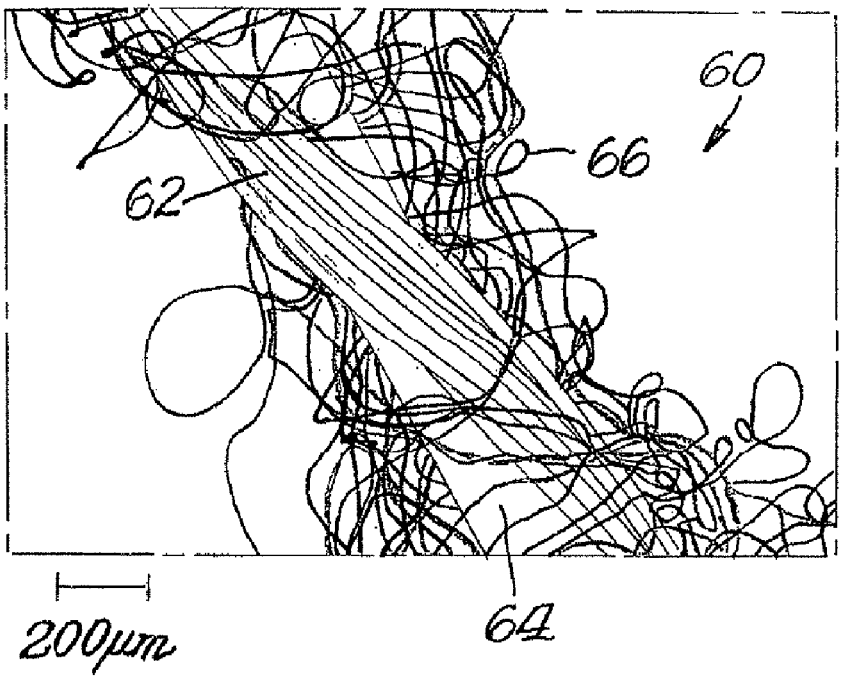

A covered yarn was made according to Comparative Example 5, except that it was single covered with a stronger nylon yarn (44 dtex/20 filaments) twisted to the "S" direction at 100 tpm. The structure of this yarn 60 is shown in FIGS. 6A and 6B, with Lycra® yarn 62 and plastic optical fiber 64 covered by nylon 66. The yarn 60 consists of straight parts as shown and loops of the optical fiber formed during relaxing the yarn. These loops can be as large as a few cm diameter so as to prohibit further processing of this yarn. As the yarn is stretched the nylon yarn breaks.

Example 2

Figure 7:
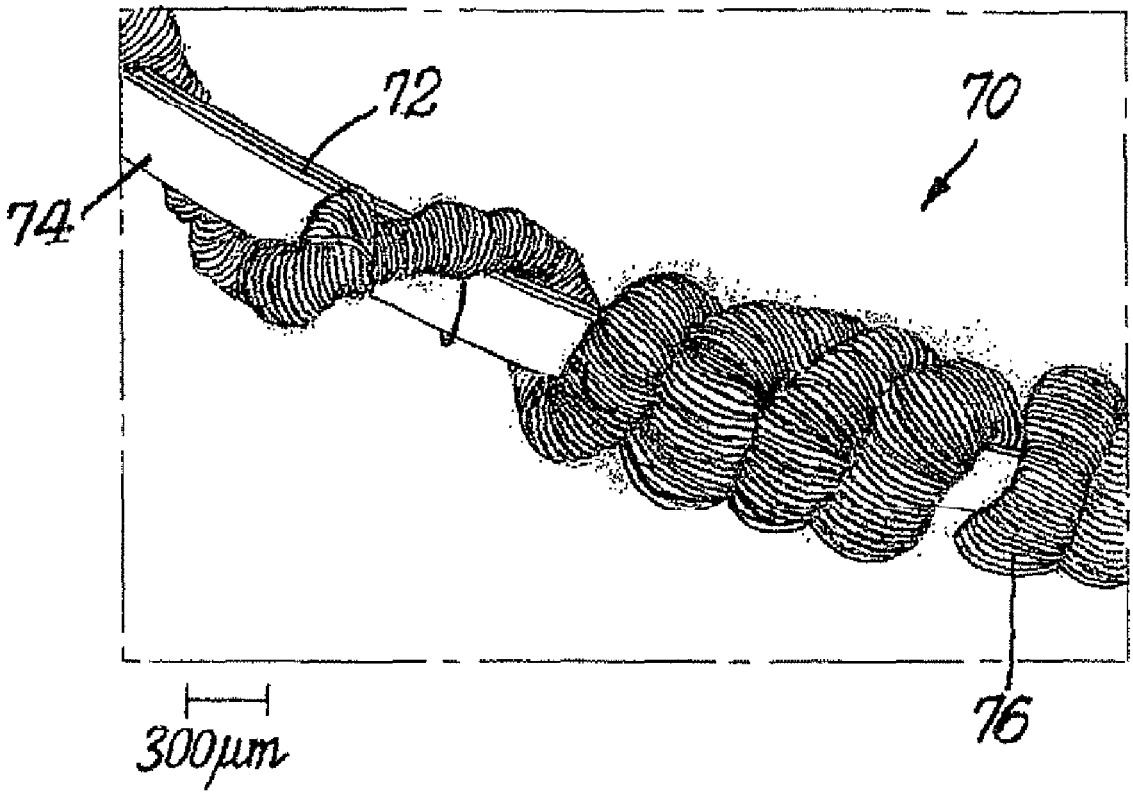
FIG. 7 shows a scanning electron micrograph (SEM) of a Raytela® plastic optical fiber in parallel to Lycra® yarn type T-162C, single covered with an elastified Lycra® yarn type T-902C (200 dtex, draft 5.2×) twisted to the "S" direction at 400 tpm.
Figure 8:
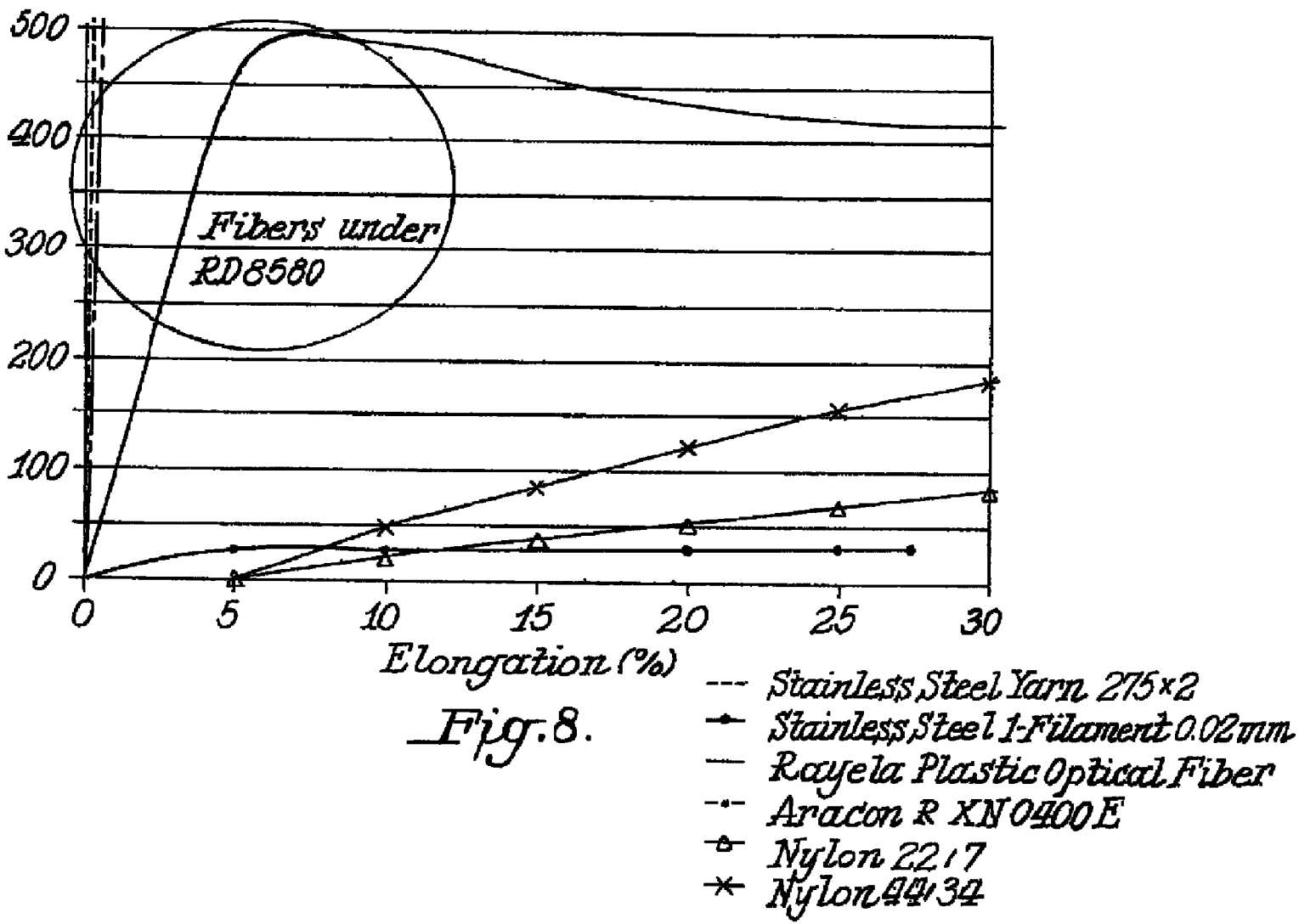
FIG. 8 shows stress-strain mechanical property data indicating modulus definition for various high modulus functional fibers and traditional textile fibers.

A covered yarn based on polymer optical fiber was formed as in Comparative Examples 5 and 6, except that the composite core yarn (consisting of Lycra® and optical fiber) was single covered with an elastified yarn twisted to the "S" direction at 400 tpm. The elastified yarn was a double covered Lycra® yarn (type T-902C, 200 dtex, draft 5.2×). The structure of this yarn 70 is shown in FIG. 7, with Lycra® yarn 72 and plastic optical fiber 74 covered by nylon 76. This yarn is composed of straight sections and small loops of optical fiber. As the yarn stretches, the loops of optical fiber straighten out with no break of the composite yarns, providing for a yarn that is processable by textile processes.

Example 3

Figure 9:
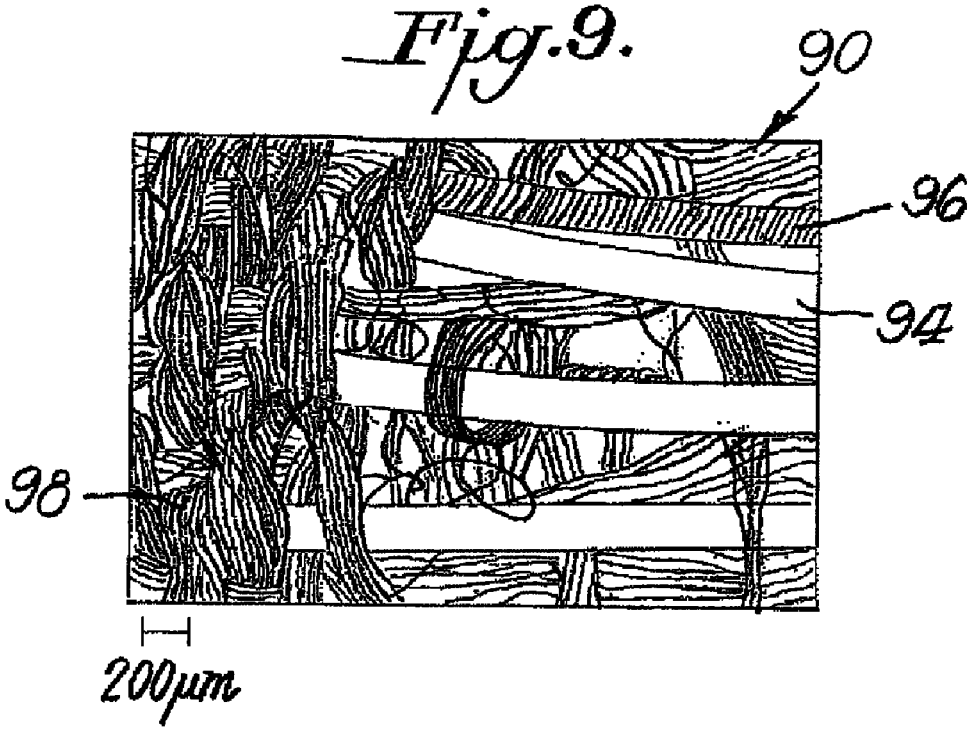
FIG. 9 shows a scanning electron micrographs (SEM) in the relaxed state of a woven fabric produced in a Jaquard weaving loom type T.I.S. TMF 100, in which an elastic fiber optic yarn containing a Raytela® plastic optical fiber in parallel to Lycra® yarn type T-162C, single covered with an elastified Lycra® yarn type T-902C (200 dtex, draft 5.2×) twisted to the "S" direction at 400 tpm, was introduced in the weft direction and the warp directed was constructed by inelastic cotton yarns.

A woven fabric 90 was produced in a Jaquard weaving loom type T.I.S. TMF 100. Elastic Fiber Optic Yarn of Example 2 was introduced in the weft direction of the fabric construction. The warp direction was constructed solely by inelastic cotton yarns 98. The fabric construction made was satin 16 to allow for maximum space between the fiber optic and the crossing warp yarns. The optical fibers introduced this way form loops of plastic optical fiber 94 that extend outside of the fabric, as shown in FIG. 9. In this case the fabric has limited stretch, for as the fabric is stretched the loops are slightly shortened but not to a complete extension.

Example 4

Figure 10A:
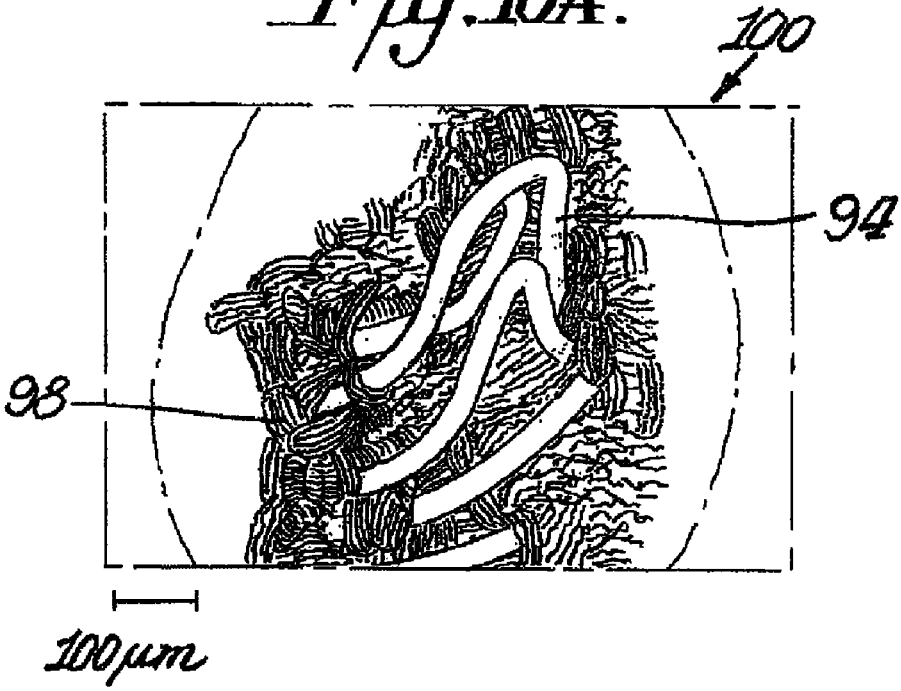
FIGS. 10A and 10B show scanning electron micrographs (SEMs) of the woven fabric shown in FIG. 9 that has been subjected to vaporization under a Hoffmann HR2A steam press table for about 1 minute in the relaxed and stretched state, respectively.
Figure 10B:
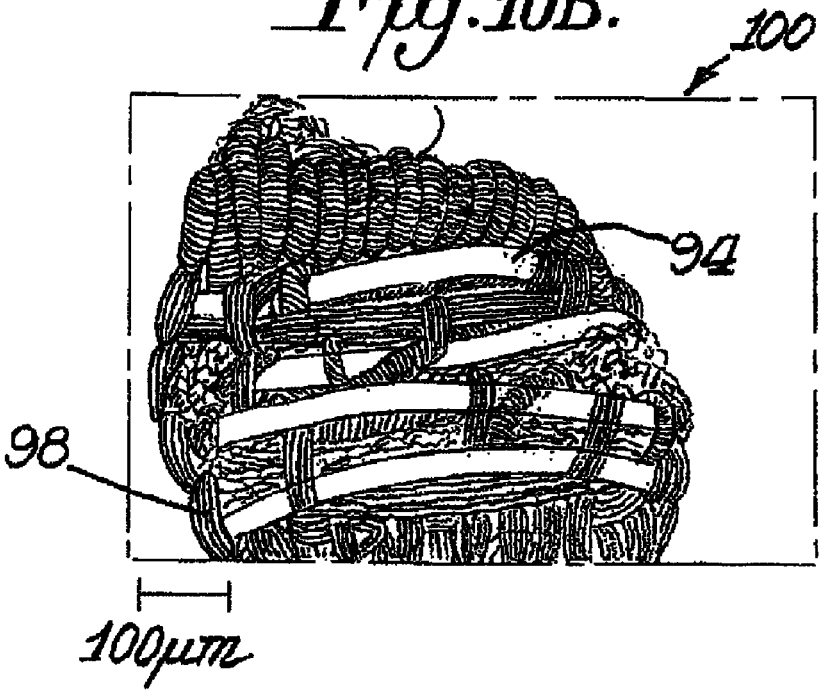

The fabric of Example 3 was subjected to vaporization under a Hoffmann HR2A steam press table for about 1 min. The woven fabric was substantially shrunk, as caused by the influence of the elastic fiber optic yarns. In this state, the fabric 100 developed a substantial stretch and recovery function. In the relaxed state, this resulted in an increased size of the fiber optic 94 loops compared to the features observed in Example 3, as shown in FIG. 10A. In the stretch state, the loops were totally flattened out resulting in a total flat surface, as shown in FIG. 10B. Thus, by controlling the stretch and recovery of the fabric, there is a control of the magnitude of the fiber optic loop bending within the textile structure.

Example 5

Figure 11A:
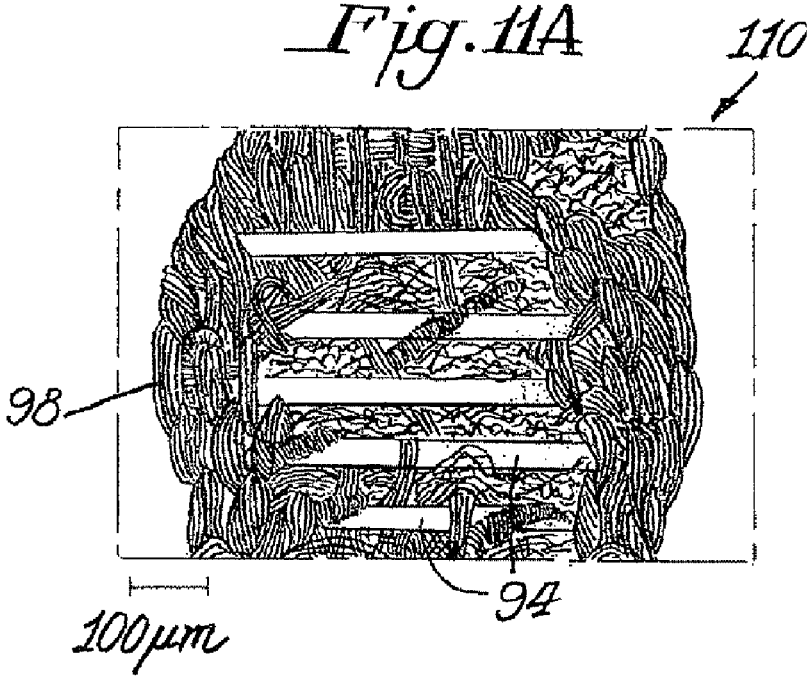
FIGS. 11A and 11B show scanning electron micrographs (SEMs) at different magnifications in the relaxed state of the woven fabric shown in FIGS. 10A and 10B that has been further subjected to heat setting through a Mathis laboratory heat stenter to about 180° C. for about 2 minutes.
Figure 11B:
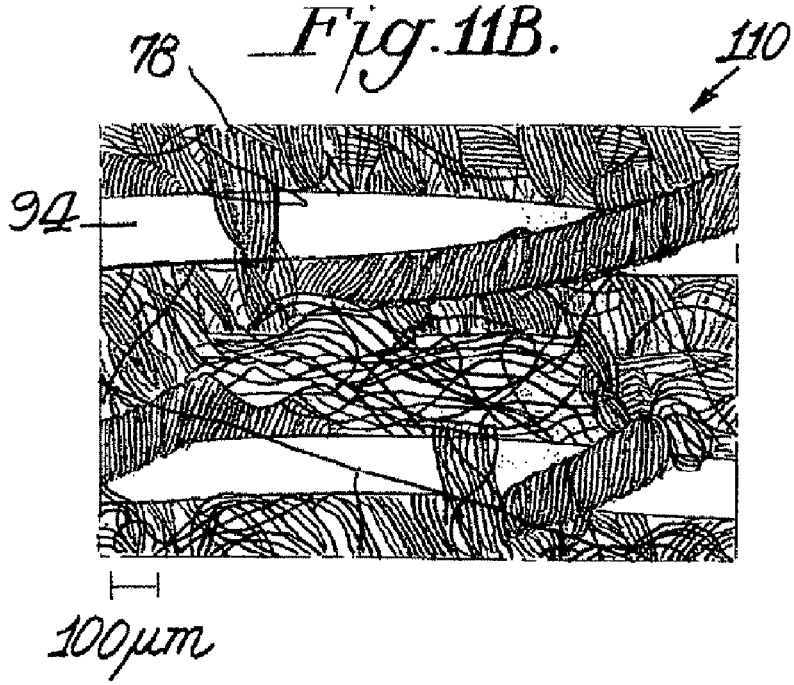

The fabric of Example 4 was subjected to heat setting through a Mathis laboratory heat stenter to about 180° C. for about 2 min. It was observed that the fabric 110 became totally rigid, and the fiber optic 94 loops totally flattened out as to create a flat fabric surface FIGS. 11A and B. It is thus possible, by controlling the heating of selecting parts of the fabric, to enforce straightening of the fiber optic loops, and therefore control of the fabric areas that can include loops or straight elements of fiber optic. This can introduce an additional degree of freedom compared to control induced by the weaving construction.

The examples are for the purpose of illustration only. Many other embodiments failing within the scope of the accompanying claims will be apparent to the skilled person.

What is claimed is:

1. An elastic composite yarn comprising:

a composite core and a composite covering;

wherein the composite core comprises:

(a) an elastic core member having relaxed unit length L and a drafted length of (N×L), wherein N is in the range of about 1.0 to about 8.0; and (b) an inelastic functional core member having a fixed length of (N×L); and wherein the composite covering comprises:

(a) at least an elastic covering member; and (b) at least one inelastic covering member surrounding the elastic covering member;

wherein the composite covering has a relaxed length that is greater than the drafted length (N×L), of the elastic core member, such that substantially all of an elongating stress imposed on the composite yarn is carried by the elastic core member and the elastic covering member.

2. The elastic composite yarn of claim 1, wherein the inelastic functional core member is selected from the group consisting of: stainless steel fibers, stainless steel yarns, plastic optical fibers, silica fibers, glass fibers, and metallized aramid fibers.

3. The elastic composite yarn of claim 1, wherein the inelastic functional core member comprises a functional yarn having at least one property selected from electrical, optical, and magnetic properties.

4. The elastic composite yarn of claim 1, wherein the inelastic functional core member has a modulus defined by (a) a force to break of greater than 2N in an elongation limit of less than 20% or (b) a yield point of greater than 2N in an elongation limit of less than 20%.

5. The elastic composite yarn of claim 1, wherein the inelastic covering member comprises a textile fiber selected from the group consisting of: nylon, polyester, cotton, and wool.

6. The elastic composite yarn of claim 1, wherein the inelastic covering member comprises a functional yarn having electrical, optical or magnetic properties with a force to break or yield point of less than 4 N.

7. The elastic composite yarn of claim 6, wherein the inelastic covering member comprises a metal wire.

8. A method for forming an elastic composite yarn comprising:

(1) providing a composite core and a composite covering; wherein the composite core comprises:

(a) a first elastic member having relaxed unit length L and a drafted length of (N×L), wherein N is in the range of about 1.0 to about 8.0; and (b) an inelastic functional member having a fixed length of N×L;

and wherein the composite covering comprises:

(a) a second elastic member;

(b) and at least one inelastic member;

(2) drafting the first elastic member to a drafted length of (N×L);

(3) placing the inelastic functional member substantially parallel to and in contact with the drafted length of the first elastic member; and (4) wrapping, twisting, air jet covering, or core spinning in turns the composite covering about the drafted first elastic member and the inelastic functional member.

9. The method of claim 8, wherein the composite covering is wrapped about the first elastic member and the inelastic functional member in a relaxed state.

10. The method of claim 8, wherein the composite covering is wrapped about the first elastic member and the inelastic functional member under tension.

11. The method of claim 8, wherein the inelastic member of the composite covering is wrapped in turns about the second elastic member.

12. The method of claim 8, wherein the inelastic member of the composite covering and the second elastic member are twisted together.

13. The method of claim 8, wherein the second elastic member is air jet covered by the inelastic member of the composite covering.

14. The method of claim 8, wherein the second elastic member is core spun with the inelastic member of the composite covering.

15. A knitted or woven fabric comprising the elastic composite yarn of claim 1.

16. A method for controlling bending of electrical or optical fibers that are inelastic functional core member(s) in a composite yarn in a fabric, comprising:

(1) providing the fabric that includes one or more elastic composite yarns, said elastic composite yarns comprising a composite core and a composite covering;

wherein the composite core comprises:

(a) an elastic core member having relaxed unit length L and a drafted length of (N×L), wherein N is in the range of about 1.0 to about 8.0; and (b) an inelastic functional core member having a fixed length of (N×L); and wherein the composite covering comprises:

(a) at least an elastic covering member; and (b) at least one inelastic covering member surrounding the elastic covering member;

wherein the composite covering has a relaxed length that is greater than the drafted length (N×L), of the elastic core member, such that substantially all of an elongating stress imposed on the composite yarn is carried by the elastic core member and the elastic covering member; and (2) dynamically controlling bending or looping of the inelastic functional core member by stretching and relaxing the elastic composite yarn(s) in the fabric.

17. The method of claim 16, further comprising differentiated heat setting the fabric.

18. A method for controlling bending of electrical or optical fibers that are inelastic functional core member(s) in a composite yarn in a fabric, comprising:

(1) providing the fabric that includes one or more elastic composite yarns, said elastic composite yarns comprising a composite core and a composite covering;

wherein the composite core comprises:

(a) an elastic core member having relaxed unit length L and a drafted length of (N×L), wherein N is in the range of about 1.0 to about 8.0; and (b) an inelastic functional core member having a fixed length of (N×L); and wherein the composite covering comprises:

(a) at least an elastic covering member; and (b) at least one inelastic covering member surrounding the elastic covering member;

wherein the composite covering has a relaxed length that is greater than the drafted length (N×L), of the elastic core member, such that substantially all of an elongating stress imposed on the composite yarn is carried by the elastic core member and the elastic covering member; and (2) heat setting at least a portion of the fabric to straighten at least some portions of the inelastic functional core member(s) in the fabric.

* * * * *

UNITED STATES PATENT AND TRADEMARK OFFICE

CERTIFICATE OF CORRECTION

PATENT NO. : 7,765,835 B2
APPLICATION NO. : 11/719116
DATED : August 3, 2010
INVENTOR(S) : Eleni Karayianni et al.

It is certified that error appears in the above-identified patent and that said Letters Patent is hereby corrected as shown below:

Title page, item [75], the address of inventor Philippe Chaudron should read -- Saint Julien en Genevois (FR); --.

Signed and Sealed this

Seventh Day of September, 2010

David J. Kappos

David J. Kappos
*Director of the United States Patent and Trademark Office*